US007477533B2

(12) United States Patent
Gilliland

(10) Patent No.: US 7,477,533 B2
(45) **Date of Patent: *Jan. 13, 2009**

(54) COMPACT CONTOUR ELECTRICAL CONVERTER PACKAGE

(75) Inventor: Patrick Gilliland, Santa Barbara, CA (US)

(73) Assignee: Wave Intellectual Property, Inc., Santa Barbara, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 11/458,947

(22) Filed: Jul. 20, 2006

(65) Prior Publication Data

US 2006/0292905 A1 Dec. 28, 2006

Related U.S. Application Data

(63) Continuation of application No. 11/149,118, filed on Jun. 8, 2005, now Pat. No. 7,101,226.

(51) Int. Cl.
*H02M 1/10* (2006.01)

(52) U.S. Cl. ..... 363/72; 363/144; 439/620.1; 439/146

(58) Field of Classification Search ..... 363/72, 363/141–146; 439/620, 957, 936, 276, 620.1
See application file for complete search history.

(56) References Cited

U.S. PATENT DOCUMENTS 5,675,485 A * 10/1997 Seong ..... 363/97
5,901,056 A * 5/1999 Hung ..... 363/142
6,091,611 A 7/2000 Lanni
6,172,811 B1 1/2001 Lanni
6,262,901 B1 7/2001 Simopoulos
6,300,743 B1 10/2001 Patino
D458,217 S 6/2002 Hawk
6,462,668 B1 * 10/2002 Foseide ..... 340/687
6,643,158 B2 11/2003 McDonald
6,650,560 B2 11/2003 MacDonald (Continued)

FOREIGN PATENT DOCUMENTS

WO WO 94/06177 A1 3/1994

(Continued)

OTHER PUBLICATIONS

"Cell-Phone Battery Charger Miniaturization Study", Sabate, Juan A., Dustera, Daniel and Sridhar, Shri, Industry Applications Conference, 2000. Conference Record of the 2000 IEEE; vol. 5, pp. 3036-3043 vol. 5.

(Continued)

*Primary Examiner*—Rajnikant B Patel
(74) *Attorney, Agent, or Firm*—Felix L. Fischer

(57) ABSTRACT

A circuit assembly and package incorporates a front cover with power contacting blades extending from a front surface thereof for electrical engagement in a receptacle having a standard peripheral dimension. A housing is attached to the front cover and extends perpendicularly therefrom. The housing contains an electrical circuit connected to the power contacting blades which is contained on a plurality of circuit boards mounted substantially perpendicular to the front cover. The housing and front cover create a footprint less than the peripheral dimension of the receptacle. A connecting cable extends from the housing and is connected to the electrical circuit.

25 Claims, 13 Drawing Sheets

U.S. PATENT DOCUMENTS

| | | | |
|---|---|---|---|
| 6,664,785 | B2 | 12/2003 | Yang |
| 6,696,825 | B2 | 2/2004 | Harris et al. |
| 6,700,808 | B2 | 3/2004 | MacDonald |
| 6,791,853 | B2 | 9/2004 | Afzal |
| 6,792,297 | B2 | 9/2004 | Cannon |
| 6,831,443 | B2 | 12/2004 | Liu |
| 6,903,950 | B2 | 6/2005 | Afzal |
| 6,937,490 | B2 | 8/2005 | MacDonald |
| 7,019,997 | B2 | 3/2006 | Ooishi |
| 7,211,986 | B1 | 5/2007 | Flowerdew |

FOREIGN PATENT DOCUMENTS

| | | | |
|---|---|---|---|
| WO | WO 00/49705 | A1 | 8/2000 |

OTHER PUBLICATIONS

Go Forward Enterprises Corp., Product Presentation Web site (www.goforward.com.tw), Photographs of AC/DC adapter part No. GP05-US0510, e-mail correspondence regarding photographed device.
CTIA Wireless Exhibitor Profile—Hypercell re new Hypercell mini-charger, alleged photographs of hypercell mini-charger.
European Patent Office automated Translation of WO 94/06177.
Respondent's Counterclaim, Apr. 23, 2007.
Respondent and Counterclaimant's Pre-Hearing Brief, Jul. 10, 2007.
Wave Intellectual Property, Inc and Patrick Gilliand's Pre Hearing Brief, Jul. 10, 2007 and Hearing PowerPoint.
Arbitrator's Post Live Hearing Report and Order #009, Jul. 19, 2007.
Respondents'/Counterclaimant's IP Counterclaim Arbitration Brief, Aug. 17, 2007.
Exhibit A4 "Plexus Hypercell Mini-Charger Investigation Findings", May 11, 2007.
Exhibit A6 Egston device history, Mar. 15, 2007.
Exhibit A7 Power Integration Design Example Report, Apr. 5, 2004.
Exhibit A8 AN1735 Applications Note, Jul. 2003.
Exhibits A9 STMicroelectronics "VIPer22ADIP-E VIPer22AS-e", Feb. 2006.
Exhibit B1 Declaration of James McGinley, Aug. 17, 2007.
Claimant and Counter Respondent's Reply Brief to Respondent and Counter Claimant's IP Counterclaim Arbitration Brief, Sep. 17, 2007.
Respondents'/Counterclaimant's Intellectual Property Counter-claims Arbitration Reply Brief, Sep. 27, 2007.
Claimant and Counter-Respondent's Supplemental Reply Brief to Respondent and Counterclaimant's IP Counterclaim Arbitration Brief, Sep. 27, 2007.
Claimant and Counter Respondents Post hearing Closing Brief, Nov. 5, 2007.
Respondent/Counterclaimant's Post Hearing Closing Arbitration Brief Nov. 5, 2007.
Claimant and Counter Respondents Wave Intellectual Property and Patrick Gilliland's Post Hearing Closing Reply Brief, Nov. 15, 2007.
Respondants/CounterClaimant's Objections to Claimant's Post Hearing Closing Reply Brief and New Evidence, Nov. 16, 2007.
Claimant and Counter-Respondents Wave Intellectual Property and Patrick Gilliland's Final Reply Brief and Response to Respondent/Counterclaimant's Objection to Claimant's Post-Hearing Closing Reply Brief and New Evidence and Declaration of David Newman, Nov. 28, 2007.
Exhibit 358 Hearing Testimony Transcript Jul. 17, 2007.
Exhibit 359 Hearing Testimony Transcript Jul. 18, 2007.
Exhibit 360 Hearing Testimony Transcript Jul. 31, 2007.
Exhibit 414 Apple iPod.
Exhibit 417 May 23, 2005 email D. Rimdzius to P. Gilliland.
Exhibit 421 Mar. 16, 2007 email D. Rimdzius to P. Gilliland.
Exhibit 443 Dec. 19, 2005 email from P. Gilliland to zephyr1147@msn.com.

* cited by examiner

COMPACT CONTOUR ELECTRICAL CONVERTER PACKAGE

REFERENCE TO RELATED APPLICATIONS

This application is a continuation of U.S. patent application Ser. No. 11/149,118 filed on Jun. 8, 2005 now U.S. Pat. No. 7,101,226 having the same title as the present application.

FIELD OF THE INVENTION

This invention relates generally to the field of compact circuit assemblies and packaging and, more particularly, to a packaged circuit for direct attachment to a wall plate duplex receptacle as a male plug having lateral dimensions within the receptacle periphery.

BACKGROUND OF THE INVENTION

Most electronic circuits which are designed to be directly powered by 110V AC circuit outlets are packaged within a rectangular module connected to the outlet receptacle with either a cord extending from the module or a plug arrangement integral with the module having blades extending therefrom for connection to the 110V AC receptacle with the module extending substantially over the entire wall plate or encroaching on the second receptacle in a duplex receptacle wall plate. Power supplies for portable computers and chargers for cellular phones and battery packs are exemplary of this type of device. While circuit improvements have reduced the size of these modules, the footprint required for direct plug arrangements is still greater than the dimension of standard duplex receptacles. This results in the ability to only use one of the receptacles in a duplex outlet or using only a two blade plug arrangement without ground pin to allow inverting the module when plugged into a top receptacle to allow use of the lower receptacle. This type of arrangement typically still encroaches on the adjacent receptacle in a four receptacle faceplate arrangement.

It is therefore desirable to have circuit module packaging and associated circuits which provide a footprint within the dimensions of a standard receptacle to allow full use of a duplex outlet while providing the ability to use a ground pin for full circuit ground implementation, where required, and plug stability provided by the additional structure of the ground pin.

SUMMARY OF THE INVENTION

A circuit assembly and package according to the present invention incorporates a front cover with power contacting blades extending from a front surface thereof for electrical engagement in a receptacle having a standard peripheral dimension. A housing is attached to the front cover and extends perpendicularly therefrom. The housing contains an electrical circuit connected to the power contacting blades which is contained on a plurality of circuit boards mounted substantially perpendicular to the front cover. The housing and front cover create a footprint less than the peripheral dimension of the receptacle. A connecting cable extends from the housing distal the front plate and is connected to the electrical circuit.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
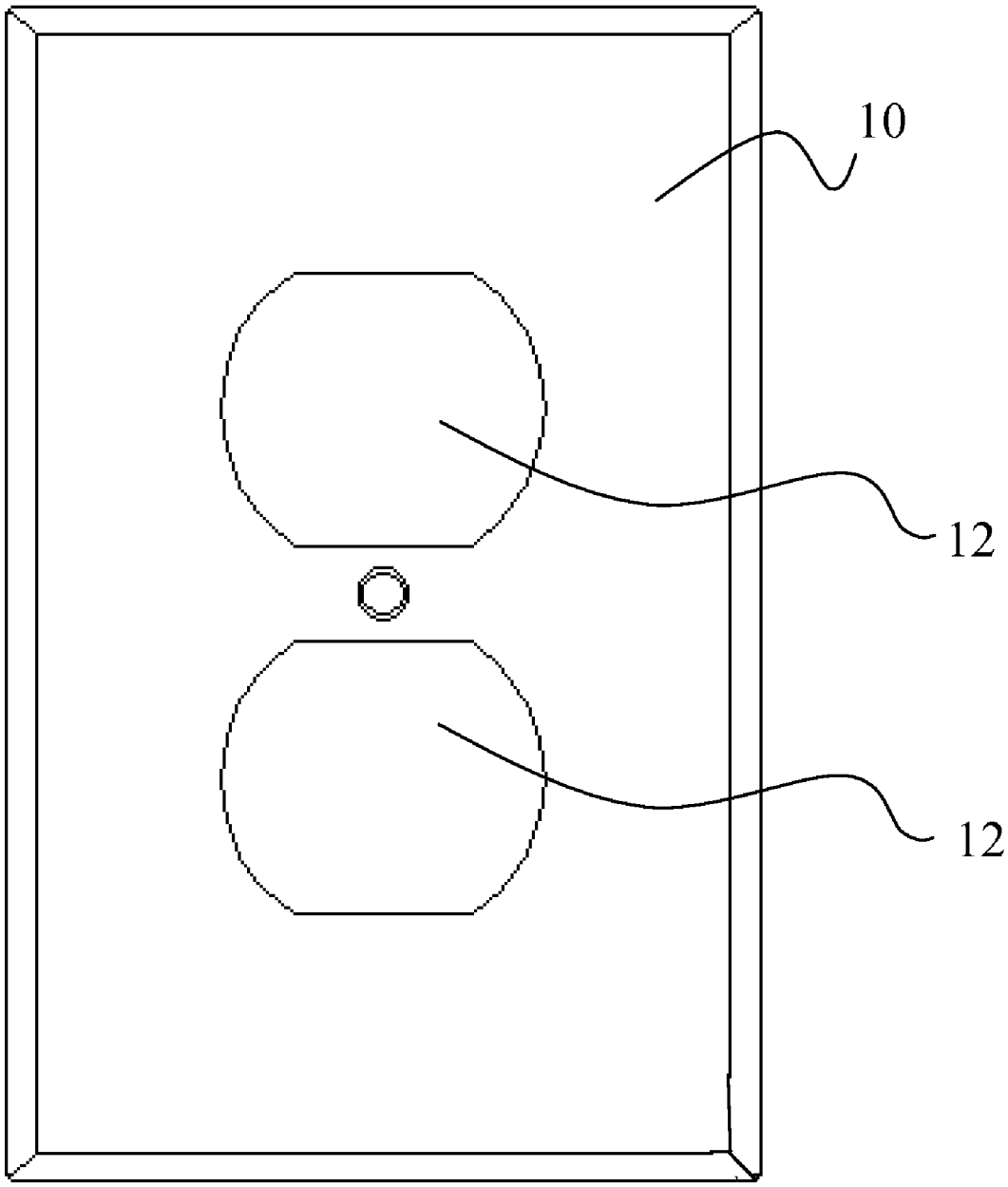
FIG. 1 is a front view of a National Electrical Manufacturers Association (NEMA) face place for a duplex receptacle.

Referring to the drawings, FIG. 1 shows a standard National Electrical Manufacturers Association (NEMA) duplex device front cover with associated dimensions. This front cover is defined by the NEMA 5-15R wallplate receptacle dimensions which accepts male plug features conforming to NEMA 5-15P. This duplex receptacle arrangement is prevalent in the majority of homes and workplaces in the United States. The wallplate 10 incorporates two receptacles 12 each having a general dimension of a 1.343 inch diameter circle truncated on the top and bottom by horizontal chords spaced at 1.125 inches from the center.

Figure 2:
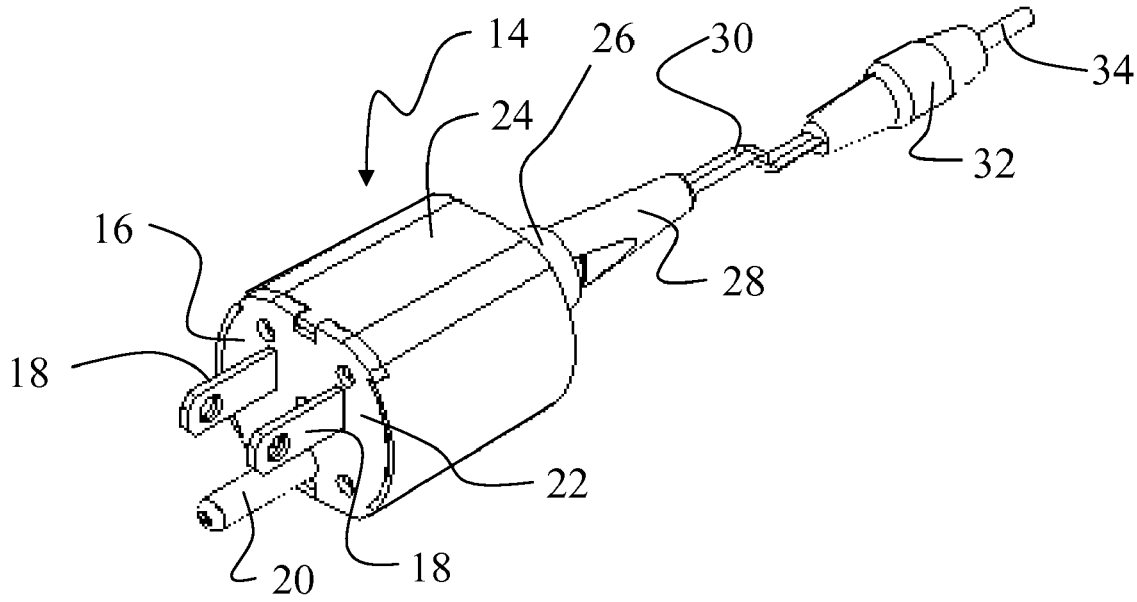
FIG. 2 is an isometric view of a circuit assembly and packaging according to the present invention.

FIG. 2 shows an embodiment of a circuit assembly and packaging unit according to the present invention. The unit includes body 14 having a front cover 16 with power connection blades 18 and a ground pin 20 extending from a front surface 22. A tapered housing 24 engages and extends from the front cover opposite the blades and houses the circuit elements of the unit. The peripheral dimensions of the front surface and housing are approximately 0.010" less than the NEMA duplex receptacle periphery as defined by the aperture in the NEMA standard duplex receptacle wallplate drawing in FIG. 1 for the embodiment shown. The tapered housing terminates in a cylindrical extension 26 which engages a strain relief 28 for connection to cord 30. A charger plug 32 having a standard male DC connector 34 is attached to the connection cord. The DC connector shown in the current embodiment is compatible with most Nokia® phones, but other DC connectors may be used for compatibility with other manufacturer's phones.

Figure 3A:
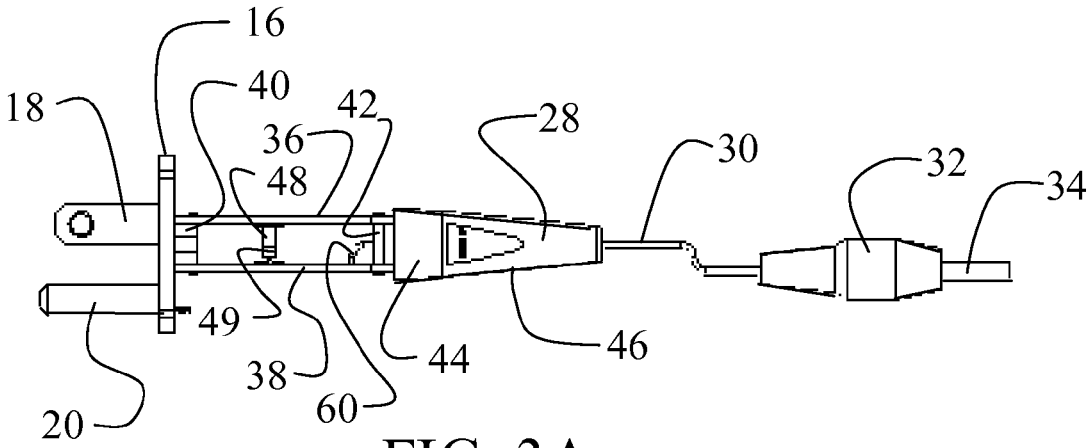
FIG. 3A is a side view of the circuit assembly and packaging of the embodiment of FIG. 2 with the tapered housing removed.
Figure 3B:
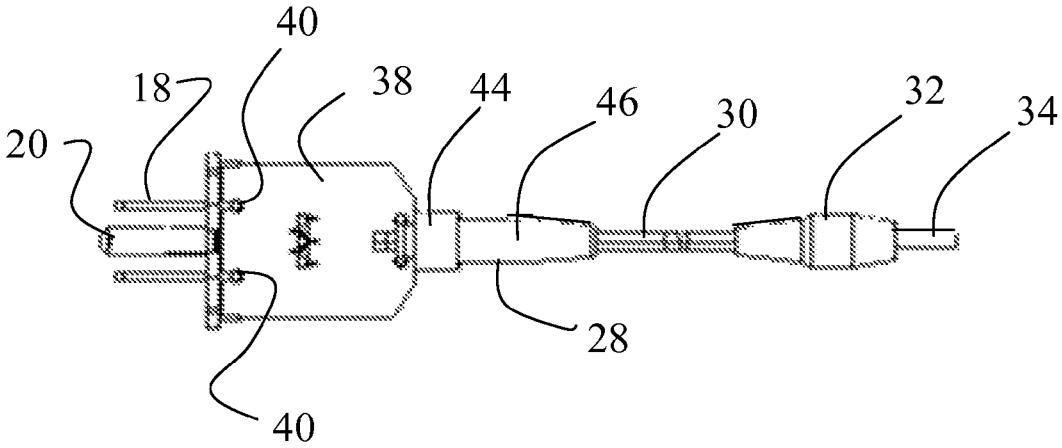
FIG. 3B is a top view of the circuit assembly and packaging of the embodiment of FIG. 2 with the tapered housing removed.
Figure 5A:
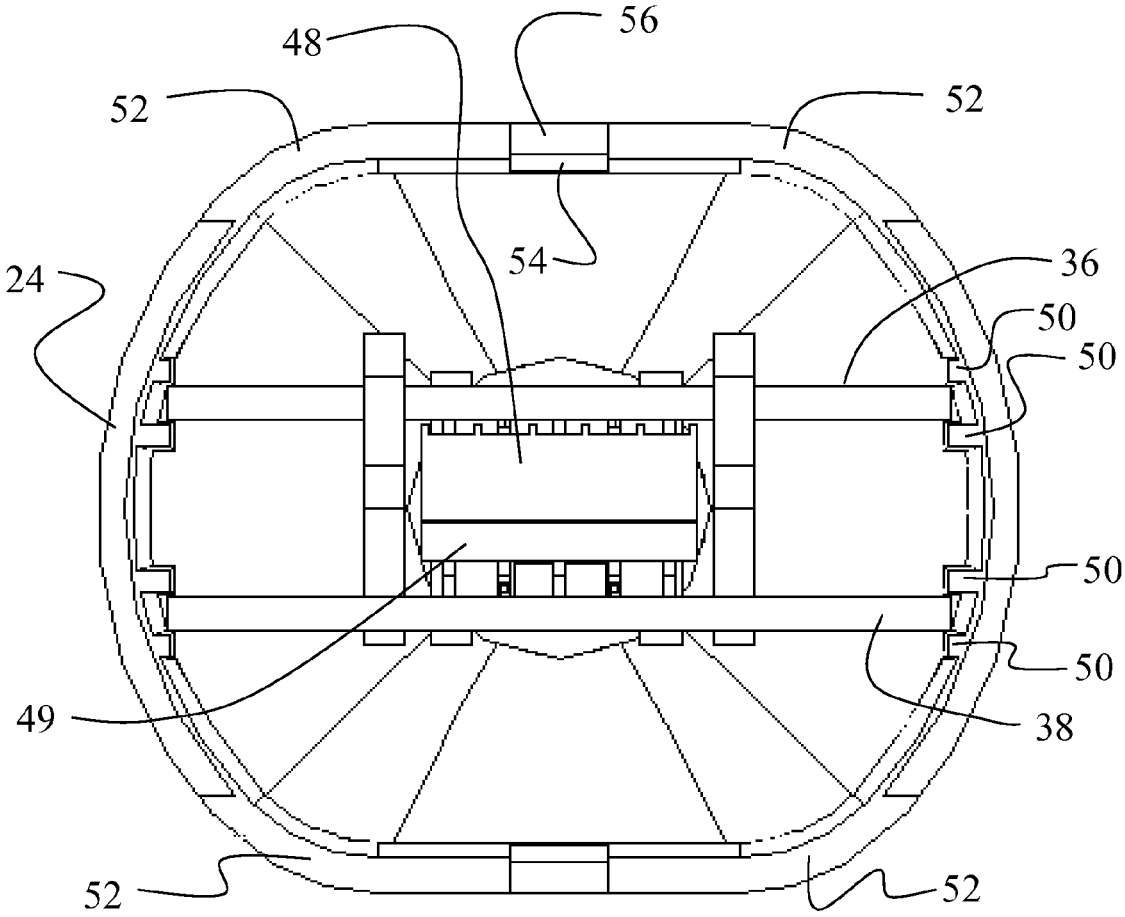
FIG. 5A is a front view of the circuit assembly and packaging of the embodiment of FIG. 2 with the front cover and associated blades and ground pin removed.
Figure 5B:
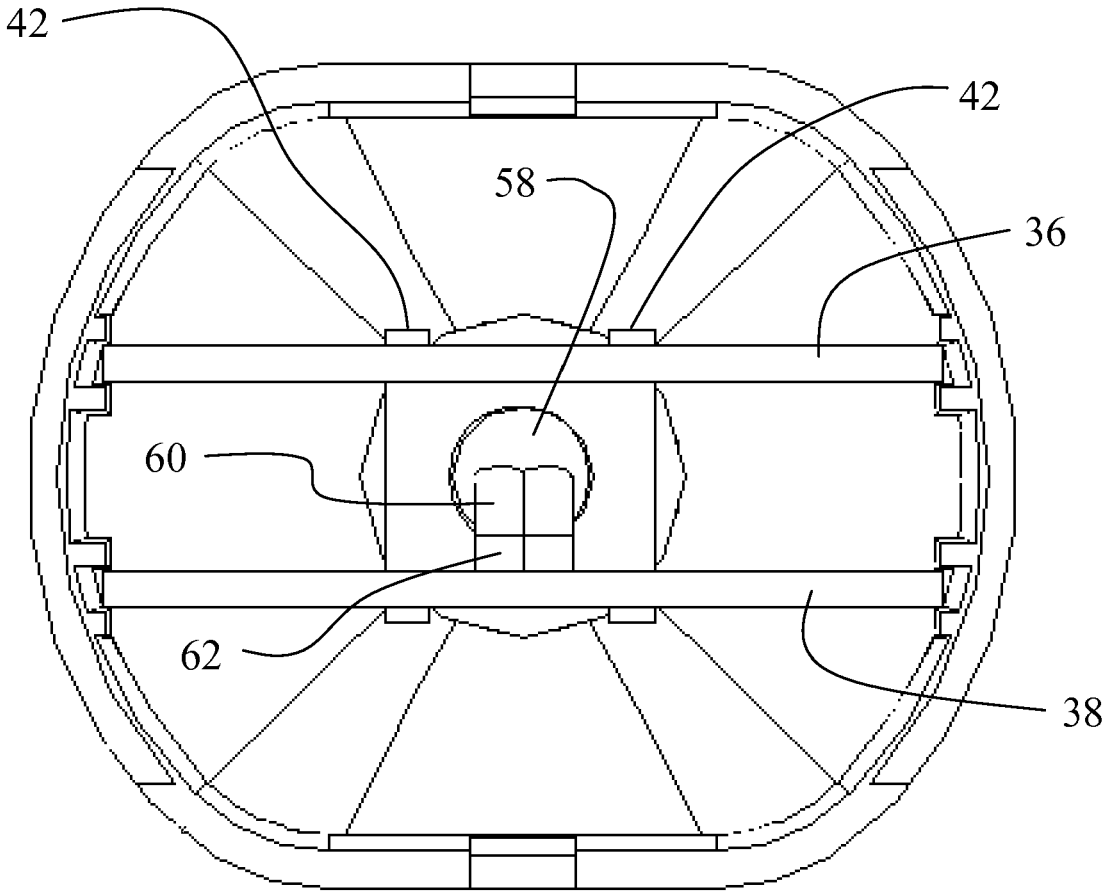
FIG. 5B is a front view as in FIG. 4*a* with the socket and header board interconnection removed to show cable attachment.

Details of the internal arrangement of the unit for the exemplary embodiment are shown in FIGS. 3A and 3B. For this embodiment, the circuit assembly is contained on two circuit boards, an upper circuit board 36 and lower circuit board 38. The power connection blades 18 incorporate a vertical arm 40 which engages and supports the circuit boards at a first end. Two posts 42 support the circuit boards at a second end opposite the front cover. For the embodiment shown herein, posts 42 are connected by a web 43 (as also shown in FIG. 5B) having an aperture for transition of the conductors of the connection cord. The strain relief for the connection cord has a slightly tapered ferule 44 extending into a tail 46 which is integrally molded into the sheathing of the connection cord for structural integrity. Interconnection between the circuit boards is accomplished by a header 48 depending from the upper board which is received in a socket 49 mounted to the opposing surface of the lower board. The header and socket provide additional structural support and rigidity between the primary structural support attachments at the board ends. By adding additional sockets to the upper circuit board 36 a third circuit board with associated headers may be mounted above upper circuit board 36. By adding additional sockets to lower circuit board 38, a fourth circuit board with associated headers may be mounted below lower circuit board 38.

Figure 4:
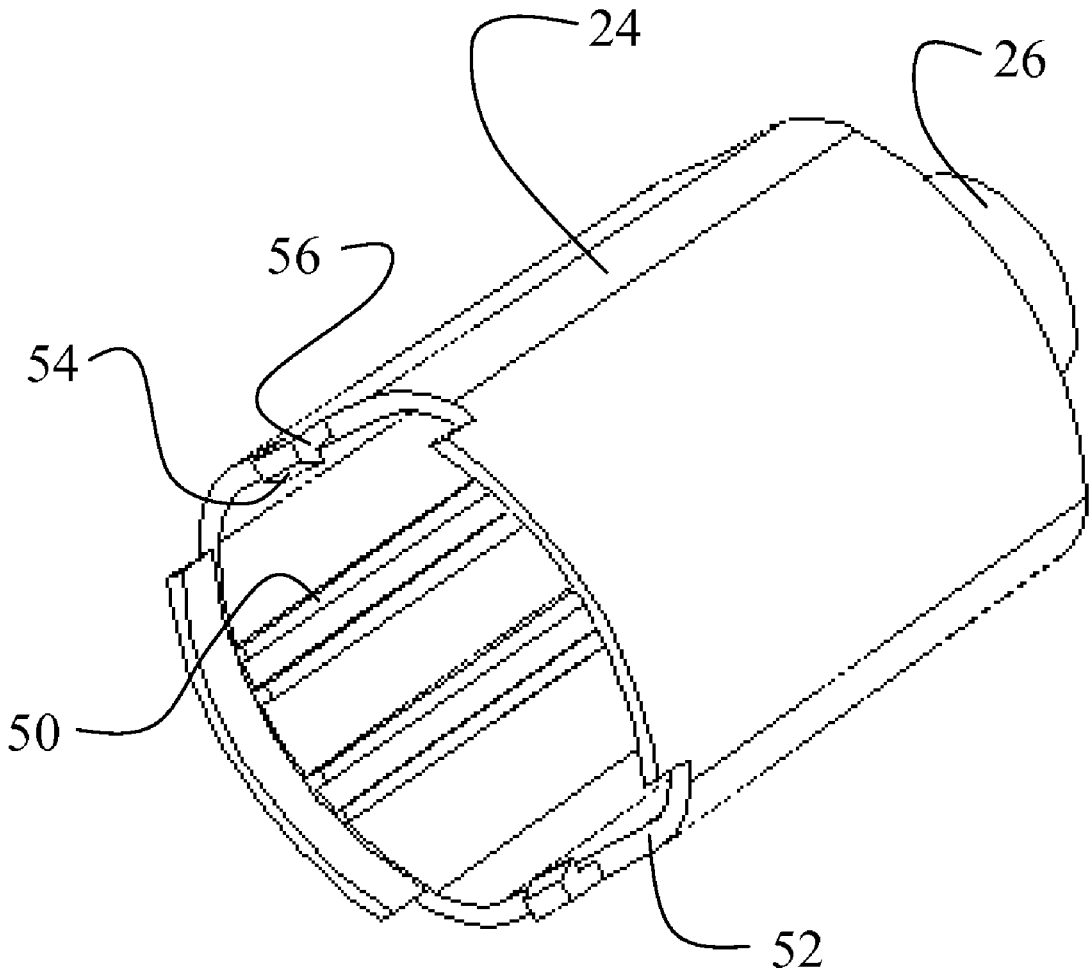
FIG. 4 is an isometric view of the tapered housing.

The tapered housing containing the electrical circuits, as shown in FIG. 4, has a truncated circular cross section footprint to fit within the NEMA wallplate aperture dimensions. Two sets of parallel ribs 50 extend from the inner circumference of the housing on each side to provide channels receiving the lateral edges of the circuit boards as best seen in FIGS. 5A and 5B. For the embodiment shown, the housing is molded using a two slide mold with a lateral slide extending through corner cutouts 52 to form engaging tangs 54 on attachment ears 56. The length of the housing accommodates the circuit boards and then tapers to the cylindrical extension 26 which incorporates a slightly tapered bore 58 to frictionally engage the ferule of the strain relief on the connection cord. Conductors 60 for the connection cord extend from the strain relief ferrule and are connected to circuit output terminals 62. The strain relief incorporates stepped cylindrical extensions from the ferrule for engagement with the web 43 and associated aperture of rear support posts 42

Figure 6A:
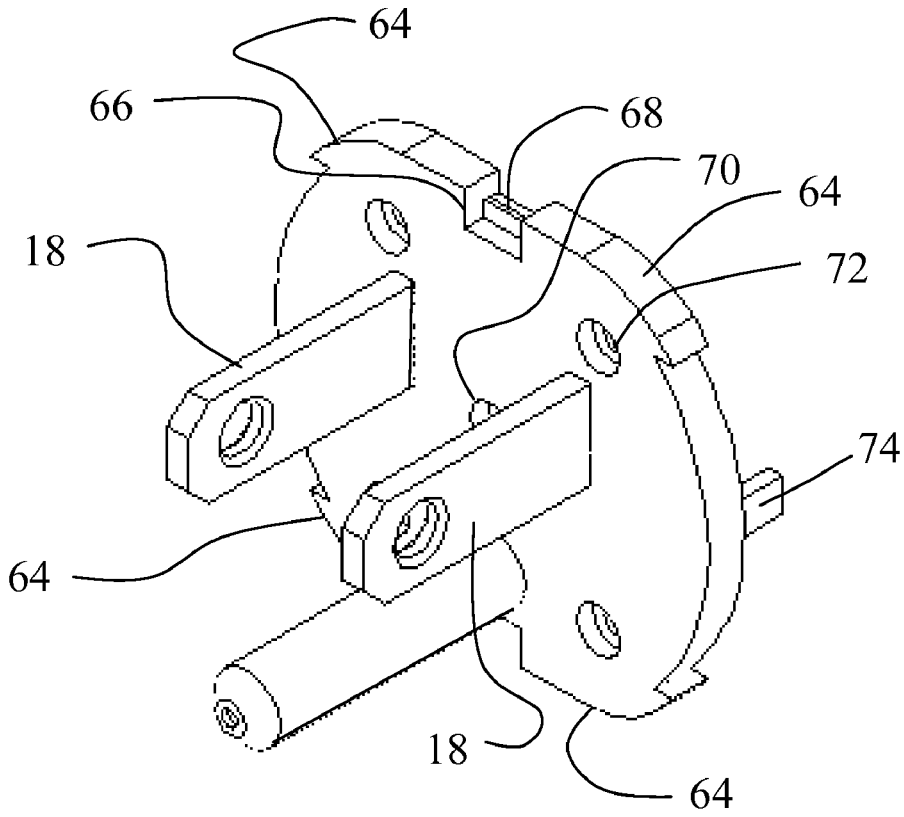
FIG. 6A is an isometric view of the front cover with the connection blades and ground pin.
Figure 6B:
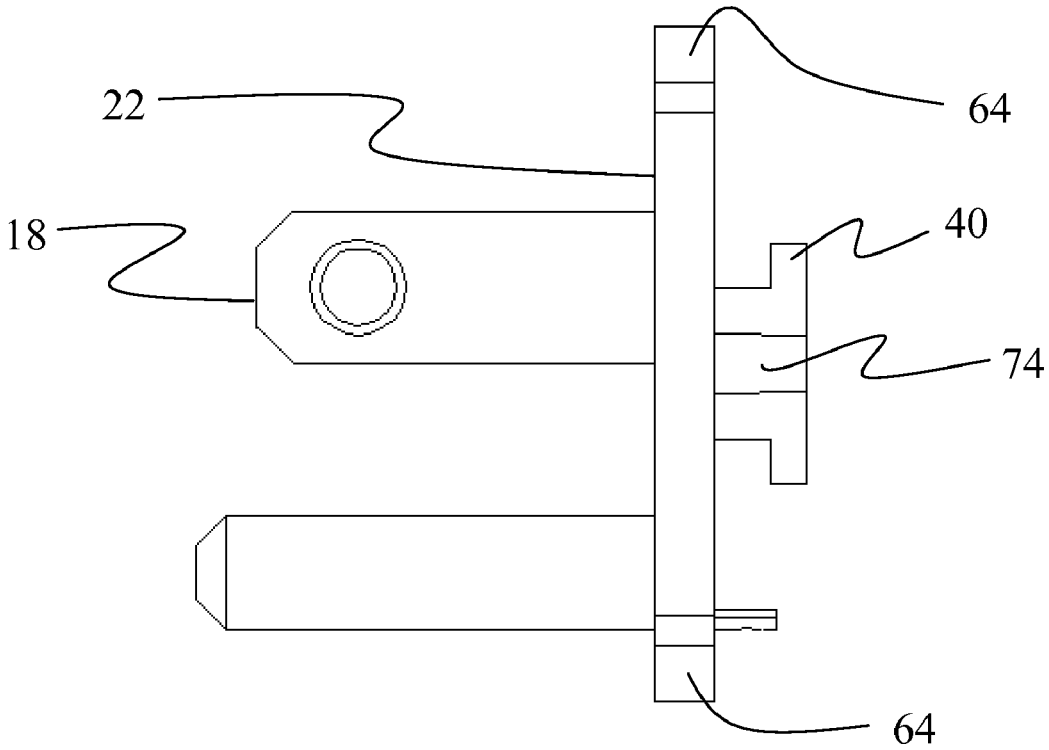
FIG. 6B is a side view of the front cover with the connection blades and ground pin.

Front cover 16, as best seen in FIGS. 6A and 6B, houses the blades and ground pin for connection to the 110 VAC outlet receptacle. Ears 64 are formed in the front plate for engagement with the corner cutouts in the housing. Notches 66 receive the attachment ears of the housing with the tang of each ear captured by webs 68 extending across bases of the notches. A central aperture 70 and four vent apertures 72 are present in the front cover to allow filling of the completed circuit assembly and packaging unit with an epoxy encapsulant, as will be described in greater detail subsequently. Two tabs 74 extend from a rear surface 76 of the front cover for positioning engagement on the internal circumference 78 in the periphery of the housing. Additionally, tabs 74 provide a protrusion for engagement with encapsulating material filling the housing, as will be described in greater detail subsequently.

Figure 7:
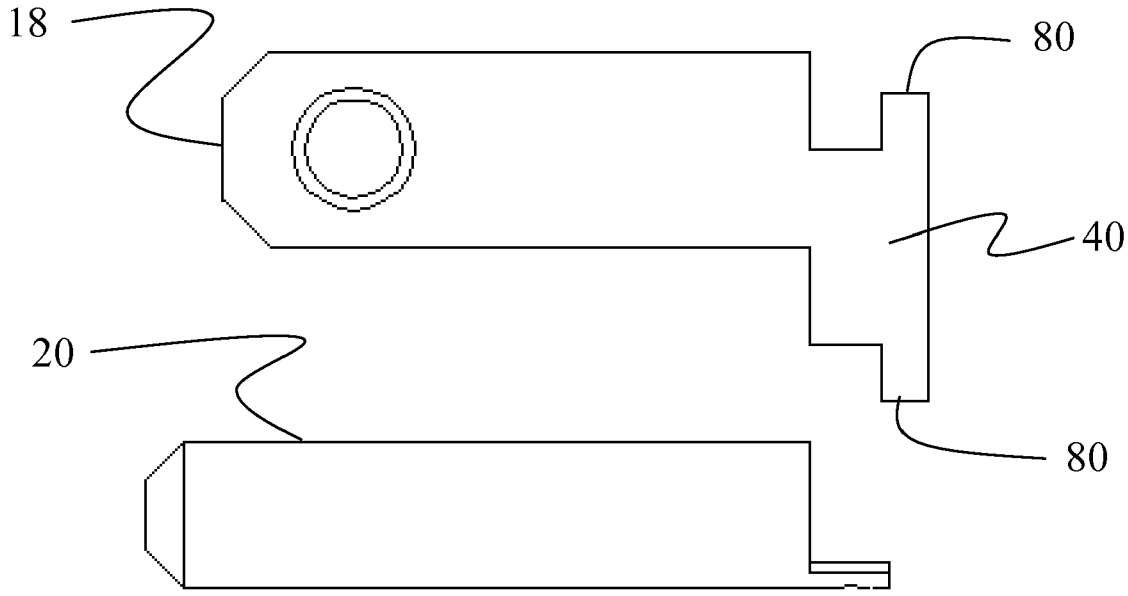
FIG. 7 is a side view of the connection blade configuration.
Figure 8A:
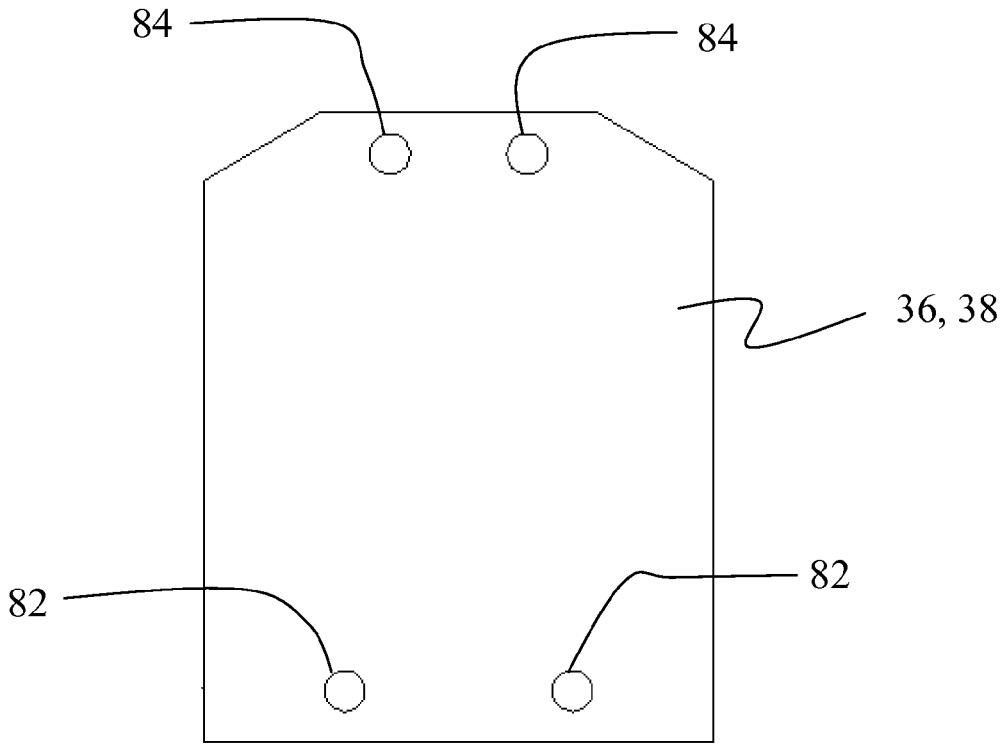
FIG. 8A is a top view of an exemplary circuit board for use in an embodiment of the invention.
Figure 8B:
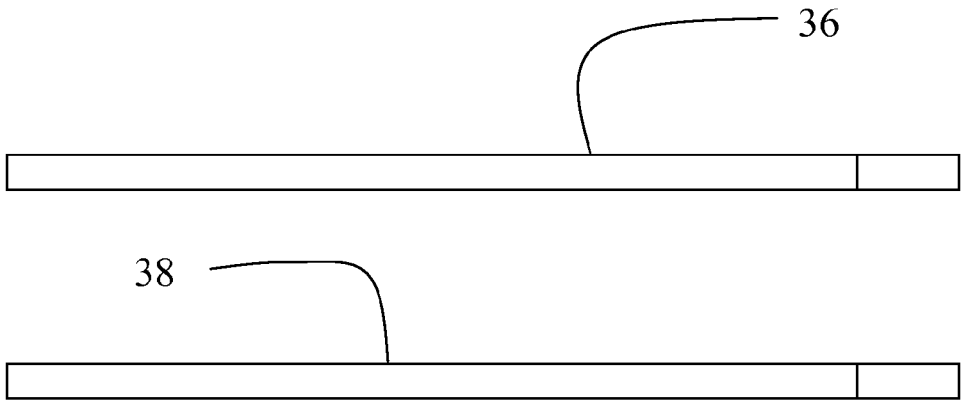
FIG. 8B is a side view of the circuit board of FIG. 9A.

The geometry of power connection blades 18 is shown in detail in FIG. 7. Vertical arms 40 on the blades terminate at both ends in rectangular posts 80 which engage the circuit boards. As shown in FIGS. 8A and 8B, the circuit boards each have forward circular engagement holes 82 which receive the rectangular posts in an interference fit. Similarly, rear engagement holes 84 receive posts 42 to maintain separation at the rear of the boards. While the embodiment shown herein employs two horizontally spaced boards, three or more boards are stacked in alternative embodiments for more complex circuits. For the embodiment shown herein, the boards have chamfered rear corners for clearance from the tapered rear of the housing.

Figure 9A:
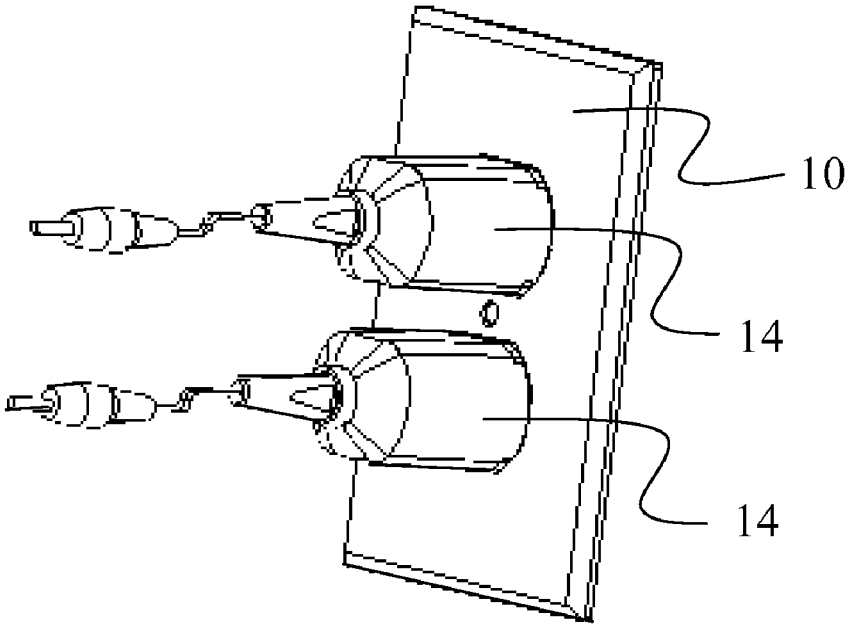
FIG. 9A is a pictorial view of two circuit assembly and packaging units according to the present invention plugged into a standard duplex receptacle.
Figure 9B:
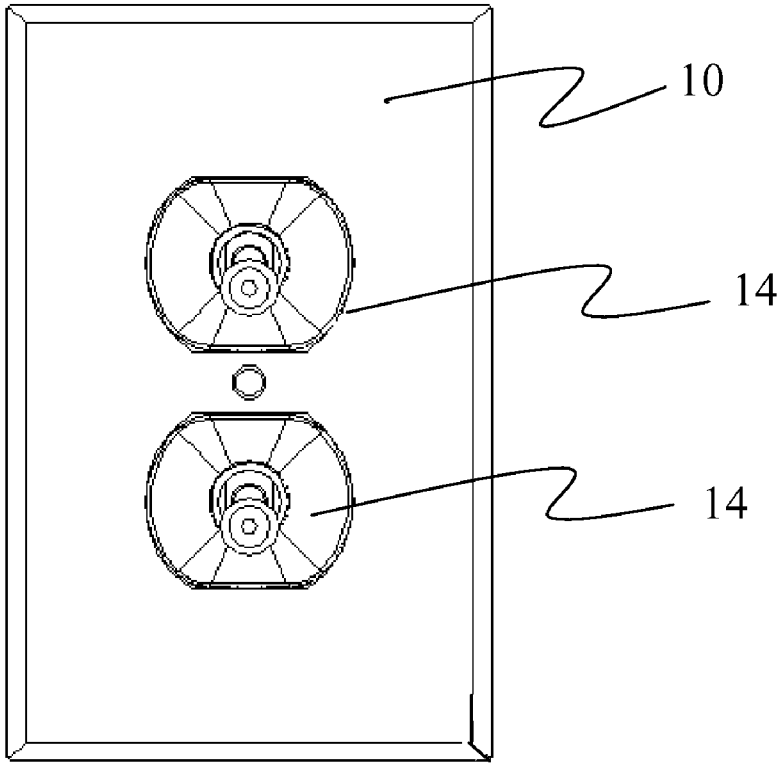
FIG. 9B is a rear view of the two circuit assembly and packaging units of FIG. 9 plugged into a standard duplex receptacle.

The efficacy of a circuit assembly and package according to the present invention is demonstrated in FIGS. 9A and 9B. Two units of the embodiment of the invention disclosed herein are plugged into the two receptacles of a single duplex face plate 10. The body 14 of each unit extends from the receptacle to which it is plugged into without interference with the second receptacle. It is unnecessary to invert the unit when plugged into a top receptacle for spacing from the bottom receptacle thereby allowing use of a ground pin both for additional structural support of the unit and electrical connection when required by the circuit assembly.

Figure 10:
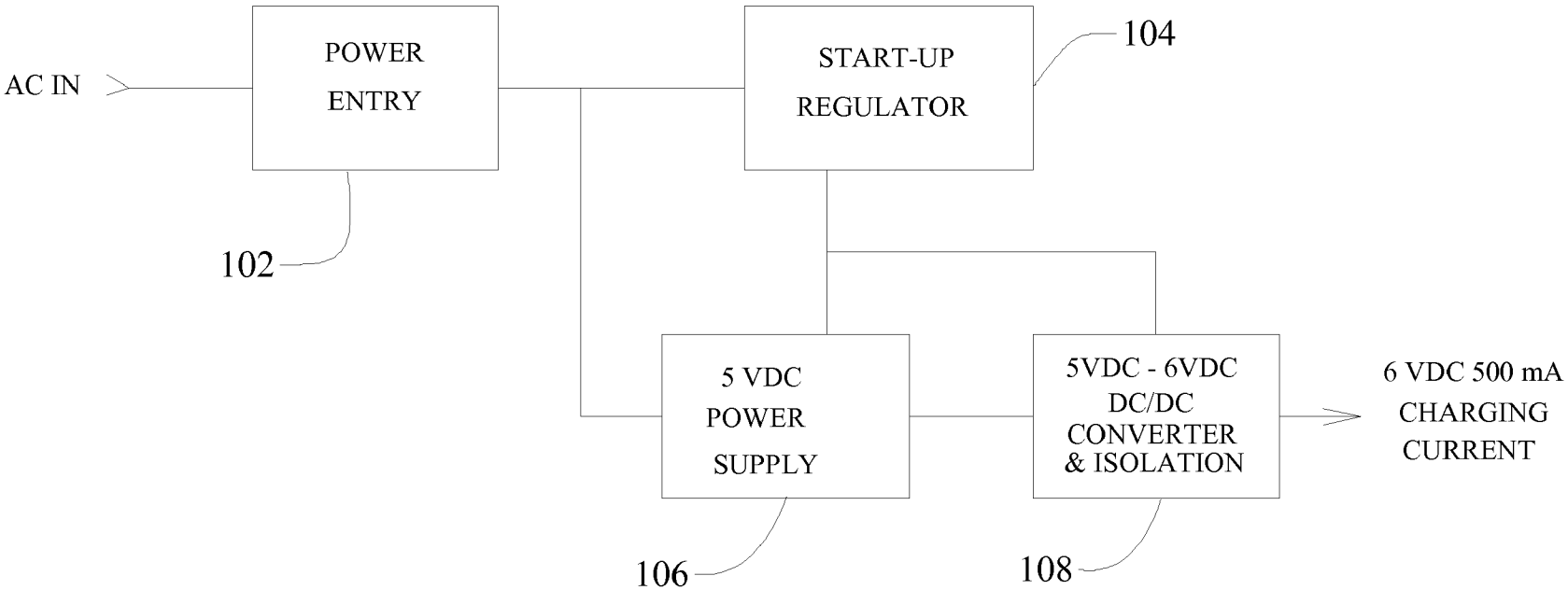
FIG. 10 is a block diagram of an exemplary 6 volt 500 milliamp charging circuit for use in an embodiment of the present invention.

An exemplary circuit for use with the present invention is shown in block diagram form in FIG. 10. The circuit comprises a 6 volt DC 500 mA charger for devices such as a cell phone or Personal Digital Assistant (PDA). 110V AC is connected to a power entry circuit 102 which supplies a start-up regulator 104 and a 5 VDC power supply 106. Startup regulator 104 provides a limited amount of current at 15VDC to the integrated circuits controlling both the 5VDC power supply 106, and the 5VDC-6VDC DC/DC converter 108. The output current of startup regulator 104 in the present embodiment is limited to about 10 mA typically. A 5VDC to 6VDC DC/DC converter and isolation circuit 108 is powered by the 5VDC power supply and provides the desired charging current output. The start-up regulator provides DC biasing supply currents for both the 5VDC power supply circuit 106 and the converter and isolation circuit 108 which both operate from DC voltages and require an initial DC voltage supply to initiate operation.

Figure 11A:
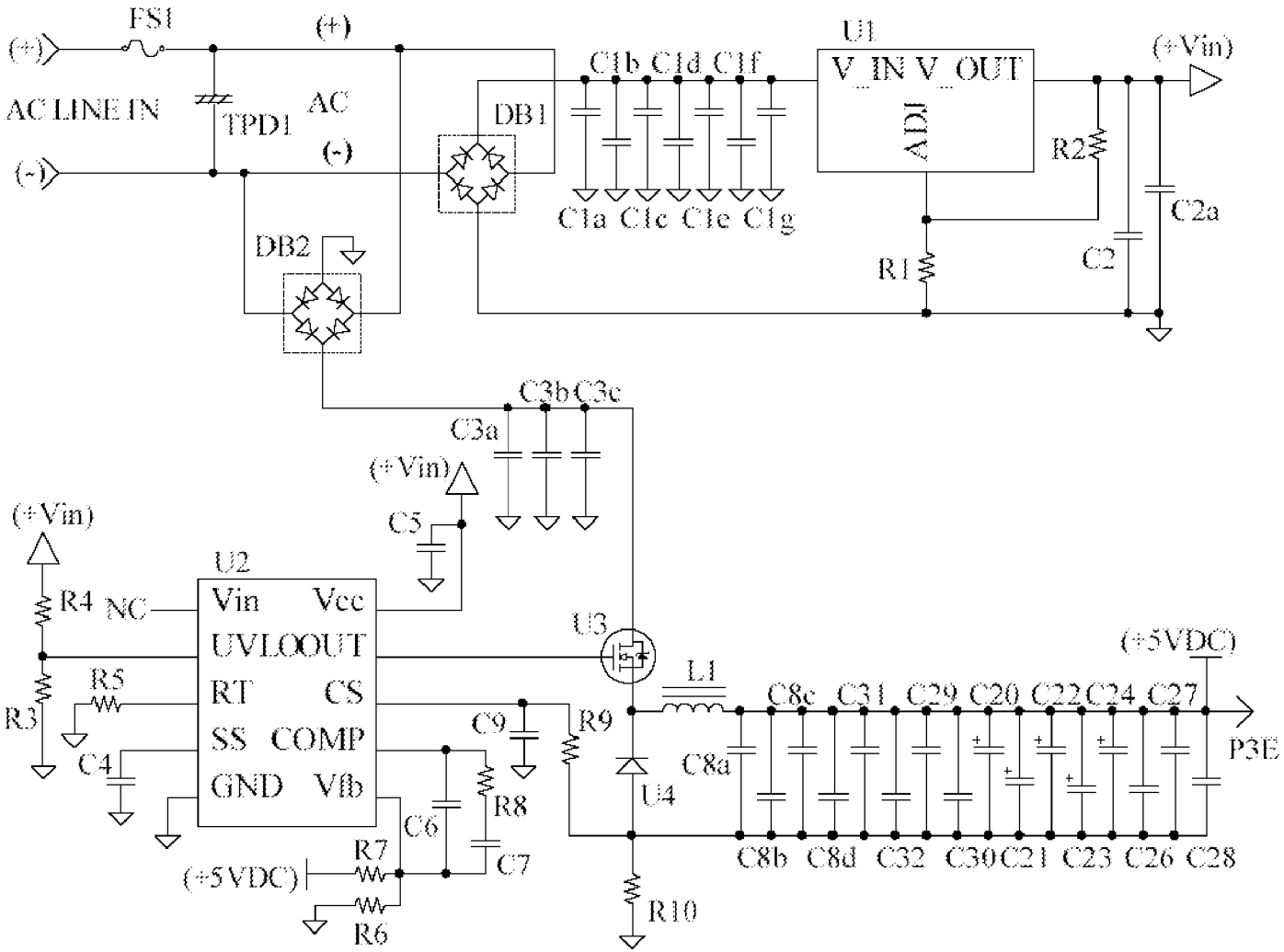
FIGS. 11A and 11B are a circuit schematic of the exemplary 6 volt 500 milliamp charging circuit of FIG. 10.
Figure 11B:
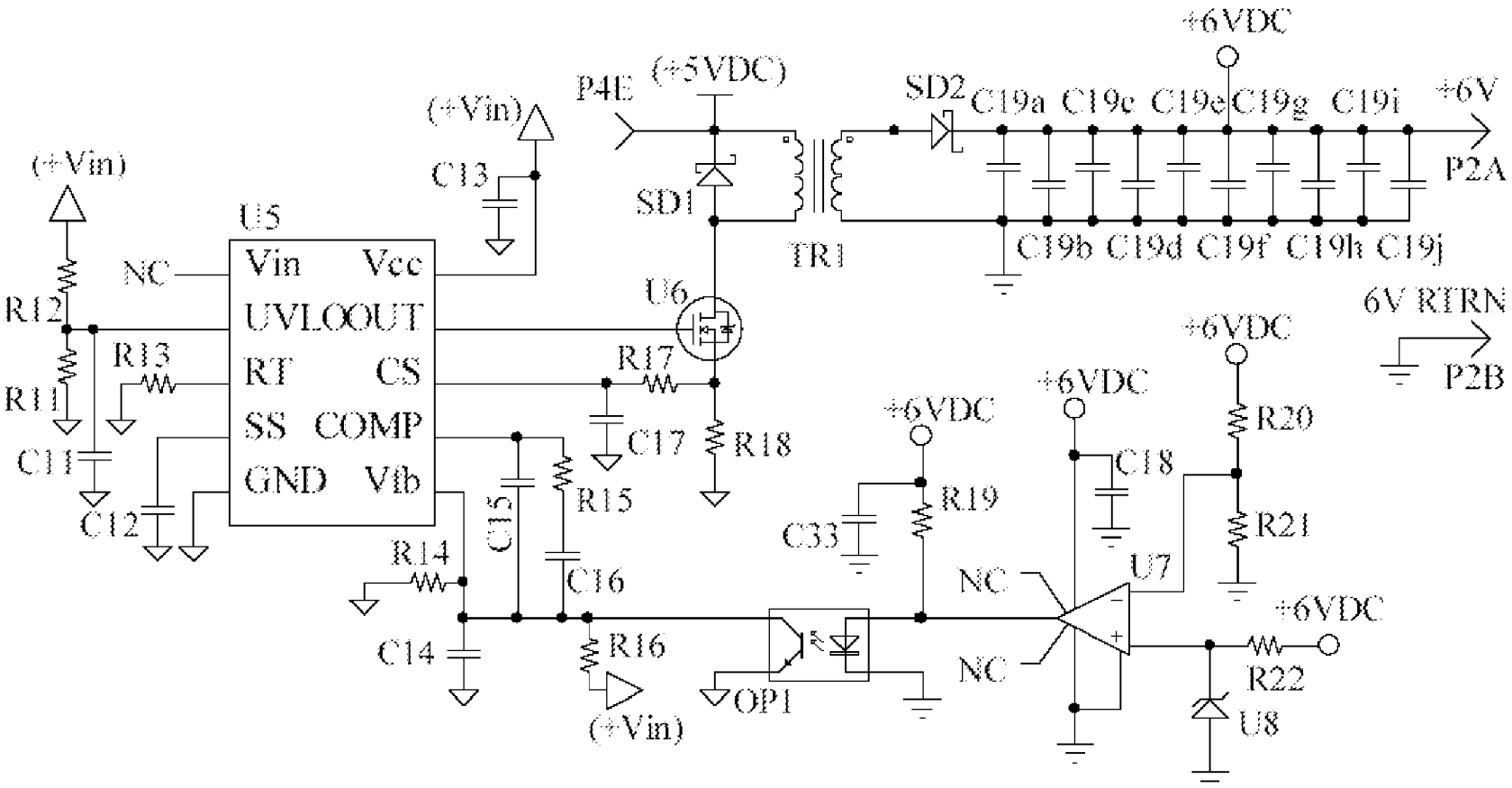

A schematic of the components contained in the circuits described in FIG. 10 is shown in FIG. 11. While described herein with respect to 110 VAC power, the circuit embodiment disclosed herein provides universal voltage input compliance (110VAC, 60 Hz/220VAC, 50 Hz). Power from the 110 VAC receptacle is received on pins P1A and P1B of the power entry circuit 102 and is series connected through fuse FS1 to provide a failsafe mechanism for disconnecting the 110VAC input in the case of either an internal short circuit or an output short circuit. For clarity in the drawings, P1A and P1B are shown as + and – respectively, however those skilled in the art will recognize in standard AC wiring circuits these comprise power, or hot, and neutral. The power entry circuit also contains a parallel connected transient protection diode TPD1 which protects the internal electronic devices against line surge voltages and plug/unplug transient voltages. The output of power entry circuit 102 supplies AC power to a start-up regulator 104 and a 5 VDC power supply 106. Startup regulator 104 provides a limited amount of current at 15VDC to the integrated circuits controlling both the 5VDC power supply 106, and the 5VDC-6VDC DC/DC converter 108. In the present embodiment, the startup regulator 104 comprises a first diode bridge rectifier DB1, a bank of high voltage capacitors C1*a*-C1*g*, and a regulation circuit, for the embodiment herein an LR8 integrated circuit from Supertex, Inc., which regulates the 110VAC rectified and filtered raw DC output down to 15VDC linearly. Feedback resistors R1 and R2 set the output DC voltage level and output capacitors C2, C2*a* provide additional filtering and leveling of the DC startup supply voltage, Vin. The output current of startup regulator 104 in the present embodiment is limited to about 10 mA typically.

AC power from the power entry circuit 102 is also provided to a second diode bridge DB2 in the 5 VDC power supply. Output from the second bridge is filtered with capacitor bank C3A-c and provided to a power FET U3. FET U3 is switched by a FET driver output signal, (OUT) from Pulse Width Modulation (PWM) controller circuit U2 which is powered by "Vin" from the regulator.

The PWM control circuit governs the amount of power delivered to output inductor L3 and the load by varying the duty cycle of a constant frequency square wave applied to the gate, or control input of power FET switch U3. Resistor R5 connected to the "RT" input of PWM control circuit U2 sets the frequency of this internal oscillator, in this case at approximately 1 MHz. When power FET U3 is switched "ON", by driver output "OUT" from PWM controller circuit U2, inductor L1 is energized and conducts current which is then accumulated on capacitor bank C8A-d and C20-32. As the voltage on the capacitor bank charges towards 5VDC, resistors R7 and R6 provide a feedback signal to PWM circuit U2. The voltage divider comprised of R7 and R6 reduces the nominal 5VDC to 1.25VDC which is compared against the internal 1.25VDC reference in the PWM controller IC. With the power FET in the "ON" condition the voltage at the 5VDC supply output will begin to go above 5VDC. When this occurs, the feedback resistive divider comprised of R7 and R6 will cause the input at the voltage feedback input (Vfb) of PWM circuit U2 to exceed 1.25VDC , thus causing the internal comparator to switch and drive the gate input of power FET U3 "LOW" so that it will switch into the "OFF" condition, and thereby foreshortening the pulse width of the positive half of the output square wave (therefore, "Pulse Width Modulation"). During the period the power FET U3 is "OFF", the energy stored in inductor L3 by virtue of its current conduction is discharged and supplied to the load and to charge the output capacitor bank through Schottky rectifier U4.

When the load on the 5VDC output causes the voltage to drop as it discharges the output capacitor bank, the process is reversed, with the voltage feedback input "Vfb" being driven below 1.25VDC, and the internal comparator switching to a "HIGH" state and driver output "OUT" switching to a "HIGH" state, causing power FET U3 to turn "ON" and repeating the cycle. In this manner the operation continues, adjusting and adapting to the varying load conditions by varying the amount of time FET U3 is turned "ON" during each cycle of the PWM control circuit U2's oscillator. The duty cycle of the PWM controller can typically vary up to 85% to provide maximum power to the load.

A soft-start capability is provided by capacitor C4 connected to the "SS" input of PWM circuit U2 in conjunction with internal circuitry to reduce the level of inrush current on a plugging event. Resistors R3 and R4 divide the "Vin" input to be compared against the under voltage lockout threshold internal to the PWM circuit U2 at input "UVL". If the voltage at "Vin" drops too low to provide proper operation of U2, this mechanism will trigger the UV Lockout provision and shut down the circuit, providing a failsafe condition. Resistor R10 is connected in series with the DC return path to the diode bridge, DB2 to provide an overcurrent sense mechanism. If the voltage across R10 indicates an overcurrent condition in the load, an internal comparator connected to the "CS" input will trigger and shut down the output drive "OUT" until proper conditions are reestablished. This overcurrent sense voltage is coupled back to the PWM controller "CS" input via resistor R9 and capacitor C9, which provide a time delay and filtering so the "CS" input does not respond to noise or transient voltages.

Compensation for duty cycles in excess of 50% is achieved by modifying the signal at the voltage feedback input "Vfb" through a network comprised of C6, C7, and R8 connected between the "COMP" and "Vfb" inputs of the PWM controller U2. The startup regulator circuit 104 supplies DC power to the PWM controller circuit through the "Vcc" input. A DC return path for the PWM IC is established by the connection of the PWM controller "GND" input to the common negative voltage reference point at the terminal of diode bridge DB2. The 5VDC supply circuit 106 as described herein is an example of a "Buck" or "stepdown" switching regulator.

The 6 VDC converter and isolation circuit receives the 5VDC power from the 5VDC power supply at pin 3 of the primary winding of transformer TR1. Use of the transformer provides a basic insulation isolation from the 110VAC line voltage to any point accessible to the end user. Basic insulation isolation is necessary to comply with Underwriters Laboratory requirements for consumer safety. PWM controller IC U5 and power switching FET U6 act in much the same manner as described above for the 5VDC supply circuit 106, with noted exceptions. Notably, the use of a 1:1.5 step-up transformer TR1 allows the output voltage of the secondary winding at pin 7 of TR1 to be greater than the input voltage, and therefore as high as 7.5VDC given a 5VDC input voltage. Additionally, the positioning of the transformer primary winding between the input DC supply and the drain of power switching FET U6, makes the FET a "Low Side" switch, simplifying the gate drive requirements, and requiring the use of a "catch" diode SD1 connected across the primary winding to reduce the potential for a possibly damaging high voltage transient at the drain of FET U6 when it is switched from "ON" to "OFF". Catch diode SD1 also provides a conduction path for the energy stored in the primary winding inductance to provide power to the load through the magnetically coupled secondary winding when power FET switch U6 is turned "OFF" by a "LOW" from the PWM circuit "OUT" output.

Output rectifier diode SD2 is connected to the secondary winding to rectify the output signal, and capacitor bank C19A-j filters and levels the 6VDC output. One other point of note is the method of feedback to PWM controller IC U6.

In order not to lose the approximately 1500V isolation achieved by the use of transformer TR1, an optocoupler OP1 is used to feedback an appropriate control signal to the PWM control IC U5 voltage feedback input "Vfb". Resistors R20 and R21 divide the nominal 6VDC output voltage to 3VDC at the inverting (−) input to voltage comparator U7. The non-inverting (+) input to voltage comparator U7 is connected to a 3VDC bandgap reference biased from the nominal 6VDC output through resistor R22. Thus, if the output rises above 6VDC, the comparator (−) input will be above 3VDC, and the voltage comparator output at pin 7 will be driven to a "LOW" state, removing the drive current from the Light Emitting Diode (LED) between pins 1 and 3 of optocoupler OP1. With no optical signal present at the base of the phototransistor between pins 6 and 4 of optocoupler OP1, the output at pin 6 will be in a high impedance state, and thus will be driven to 2.5VDC by the resistive voltage divider (½) combination formed by R16 and R14 and the 15VDC startup supply output, "Vin". Since the internal reference is at 1.25VDC, the output drive from PWM control circuit U6 "OUT" will be driven "LOW" and the power switching FET U6 turned "OFF", thus providing negative feedback and maintaining excellent isolation.

When the nominal 6VDC output sinks below 6VDC, the (−) input to voltage comparator U7 sinks below 3VDC, and the output of voltage comparator U7 transitions to a high impedance state, and is pulled "HIGH" towards 6VDC through pullup resistor R19. The actual voltage will be determined by the forward current (~2 mA) through the LED between pins 1 and 3 of optocoupler OP1. With the now substantial optical power incident on the phototransistor base, and the high gain of the phototransistor between pins 6 and 4 at the second side of optocoupler OP1, the voltage at the optocoupler output pin 6 is quickly driven to the saturation voltage of the phototransistor (<0.4VDC). This will cause the output of PWM control circuit U5 "OUT" to be driven "HIGH", thus turning power switch FET U6 "ON", reenergizing the primary winding of transformer TR1, and repeating the cycle anew as the nominal 6VDC voltage output is driven higher. Capacitor C14 and resistor combination R14 and R16 behave as an integrating circuit, delaying both the rising voltage and falling voltage at the voltage feedback input "Vfb" of PWM control IC U5, and therefore consideration must be given to compensate the feedback loop appropriately via the "COMP" input to PWM IC U5

Besides the noted exceptions, the remainder of the PWM IC operates as described previously and will not be repeated here. This DC/DC converter topology is commonly referred to as a "Boost" or "Flyback" converter. Values for exemplary components of the circuits and various feedback control components for the circuits described above and shown in FIGS. 11A and 11B are provided in table 1. The design has been effected in such a manner as to allow interfacing with both the US standard 110VAC and many of the international 220VAC power mains. Suitable passive plug adaptors may be used to effect the mating to a number of different international plug receptacle standards.

TABLE 1

| Component | Value | Part no./Type |
|---|---|---|
| R10, R18 | 0.33 Ohm | ERJ-3RQFR33V |
| R9, R14, R17 | 1 K | ERJ-3EKF1001V |
| R2 | 1.82 K | ERJ-3EKF1821V |
| R3, R11, R19 | 2 K | ERJ-3EKF2001V |
| R6 | 3.01 K | MCR03EZPFX3011 |
| R16, R20, R21, R22 | 4.99 K | MCR03EZPFX4991 |
| R5 | 6.19 K | ERJ-3EKF6191V |
| R7 | 9.09 K | MCR03EZPFX9091 |
| R4, R8, R12, R15 | 15 K | ERJ-3EKF1502V |
| R1, R13 | 20 K | ERJ-3EKF2002V |
| C6, C15 | 220 pF | ECJ-1VC1H221J |
| C7, C16 | 3.3 nF | C1608C0G1H332J |
| C4, C12 | 0.01 uF | ECJ-1VB1E103K |
| C2, C5, C9, C11, C13, C14, C17, C18, C33 | 0.1 uF | MCH182CN104KK |
| C1a-C1g, C3A-C3c | 0.56 uF | 501S49W564KV6E |
| C2a, C8A-C8d, C19A-C19j, C26-C32 | 22 uF | C3225X5R1E226K |
| C20-C25 | 220 uF | ECEV1AA221XP |
| L1 | 68 uH | MSS1260-683MX |
| TR1 | Transformer | PA1032 |
| DB1, DB2 | Diode Bridge 400 V 0.8 A | HD04 |
| U1 | 450 V Linear Reg. 10 mA | LR8N8 |
| U2, U5 | 100 V PWM Controller | LM5020MM-1 |
| U3, U6 | N-Ch Pwr MOSFET 600 V 1 A DPAK | STD1NB60 |
| U4 | Fast Recovery Rectifier 400 V 1 A | SMBY01-400 |
| U7 | Voltage Comparator | LM311M |
| U8 | Voltage Reference 3.0 V SOT-23 | LM4040EIM3X-3.0 |

TABLE 1-continued

| Component | Value | Part no./Type |
|---|---|---|
| SD1, SD2 | Schottky Diode 40 V 2 A SOT23-6 | ZHCS2000 |
| OP1 | Optocoupler | TLP181 |
| FS1 | FUSE 1025TD 250 VAC 250 mA | 1025TD250mA |
| TPD1 | Trans. Voltage Processor 350 V, 400 W | P4SMA350CA |
| P3 | 2 mm 5-pin Receptacle | 2063-01-01-P2 |
| P4 | 2 mm 5-pin Header Straight | 2163-01-01-P2 |

For the embodiment described herein, a simplified method of manufacture on the unit is created by the form of the packaging components. Power blades 18 and ground pin 20 are integrally molded into front cover 16. Assembly of the circuits on circuit boards 36 and 38 is accomplished by conventional pick and place and soldering methods. The connecting cable strain relief is engaged to web 43 interconnecting support posts 42 with the stepped cylindrical extension inserted through the aperture in the web. The conductors of the connecting cable are connected to associated lower board terminals. The two circuit boards are then mounted to pins 80 on the vertical arms of the power blades with front mounting holes 82, as previously described, and then soldered for electrical connection. Coincident with mounting to the vertical arms, the socket and header on the boards are mated and posts 42 are inserted in the rear mounting holes on the boards and soldered for structural support and rigidity at the rear of the multi-board assembly.

The connecting cable is threaded through the tapered bore in the cylindrical extension of the housing. The tapered ferule 44 of the strain relief engages the tapered bore to preclude pull through of the cable assembly and to provide a liquid tight seal. The printed circuit boards are inserted into the channels formed by ribs 50 and sliding engage the channels while the cable is drawn through the bore. The housing is snap fit onto the front cover employing attachment ears 56 which are received by the notches 66 in the front cover with the tangs 54 on the ears then constrained by the webs 68 in the notches. Ears 64 on the front cover are closely received in corner cutouts 52 in the housing.

Upon completion of mechanical assembly, the unit is positioned vertically with the front cover at the top. A high thermal conductivity encapsulating compound is then injected through central aperture 70, using a syringe or comparable injection tool, with venting through apertures 72 providing encapsulation of the circuit boards and connections for additional structural rigidity of the entire unit as well as shock protection and thermal conduction for the circuit elements on the circuit boards. Tabs 74 on the front cover are engaged by the encapsulating material to provide additional structural connection to the housing.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. An electrical converter comprising:

an alternating current plug body with electrical contacts extending perpendicularly from a front surface thereof for electrical engagement in a receptacle having a peripheral dimension, said plug body having a footprint less than the peripheral dimension of the receptacle, the electrical contacts extending rearwardly from said front surface and including an integral vertical arm supporting two circuit boards mounted proximate a front edge to opposite ends of the vertical arm and containing a power entry circuit with a line voltage input connected to at least one electrical contact and having at least one means for interrupting the line voltage input;

a startup regulator having a first rectifier connected intermediate the power entry circuit and a regulation circuit charging a startup voltage storage capacitor, the startup regulator further having a feedback circuit for setting the startup voltage level;

a power supply having a second rectifier connected to the power entry circuit and having:

a power storage capacitor connected to the second rectifier, a first power FET connected to the power storage capacitor;

an output inductor connected to the power FET, and a first switching regulator control circuit powered by the startup regulator for regulating switching of the first power FET, a converter and isolation circuit having a first isolation device connected between the power supply output and a converter output, a second power FET controlling power through the first isolation device, a second switching regulator control circuit powered by the startup regulator and regulating switching of the second power FET, a feedback circuit for control of the second switching regulator control circuit, a connecting device connected to the electrical circuit and including a connecting device body received in an opening in the alternating current plug body distal the front surface and extending from the housing perpendicular to the front surface.

2. An electrical converter as defined in claim 1 wherein the feed back circuit incorporates a second isolation device.

3. An electrical converter as defined in claim 1 wherein the first isolation device is an isolation transformer having a primary winding connecting the power supply output inductor and the second power FET and a secondary winding connected to the converter output.

4. An electrical converter as defined in claim 1 wherein a first power storage capacitor is connected to the output inductor.

5. An electrical converter as defined in claim 1 wherein the converter output is provided through a second storage capacitor.

6. An electrical converter as defined in claim 1 wherein an output rectifier is connected intermediate the first isolation device and the converter output.

7. An electrical converter as defined in claim 3 further comprising a catch diode connected across the primary winding.

8. An electrical converter as defined in claim 2 wherein the second isolation device is an optocoupler.

9. An electrical converter as defined in claim 1 wherein the power entry circuit has a means for surge and transient protection.

10. An electrical converter as defined in claim 9 wherein the means for surge and transient protection is a parallel transient protection diode connected across the line voltage input.

11. An electrical converter as defined in claim 1 wherein the interruption means is a fuse.

12. An electrical converter as defined in claim 1 further comprising a second power storage capacitor connected to the output inductor.

13. An electrical converter comprising:

an alternating current (AC) plug body having a front surface with electrical contacts extending therefrom, the plug body having a peripheral dimension substantially contained within a maximum peripheral dimension of a mating AC receptacle, the electrical contacts further extending rearwardly from said front surface and including an integral vertical arm supporting two circuit boards mounted proximate a front edge to opposite ends of the vertical arm the plug body containing a power entry circuit on one of said circuit boards with a line voltage input;

a startup regulator on one of said circuit boards having a first rectifier connected to the power entry circuit and having a first voltage output;

a power supply connected to the power entry circuit and controlled by the first voltage output, the power supply having a second voltage output;

a converter and isolation circuit on one of said circuit boards having a first isolation device connected between the second voltage output and a converter output, a power FET controlling power through the first isolation device, a switching regulator control circuit powered by the first voltage output and regulating switching of the power FET, a feedback circuit having a second isolation device for control of the switching regulator control circuit, and, a connecting cable with a plurality of conductors extending from the alternating current plug body distal and perpendicular to the front surface and connected to an output end of the electrical circuit.

14. An electrical converter as defined in claim 13 wherein the first isolation device is an isolation transformer having a primary winding connecting the power supply second voltage output and the power FET and a secondary winding connected to the converter output.

15. An electrical converter as defined in claim 13 wherein the second isolation device is an optocoupler.

16. An electrical converter as defined in claim 13 wherein the power entry circuit has at least one means for disconnecting the line voltage input.

17. An electrical convener as defined in claim 13 wherein the power supply includes a second rectifier connected to the power entry circuit and has:

a power storage capacitor connected to the second rectifier, a supply power FET connected to the power storage capacitor;

an output inductor connected to the power FET to provide the second voltage output, and a supply switching regulator control circuit powered by the startup regulator for regulating switching of the first power FET.

18. An electrical convener as defined in claim 13 wherein the startup regulator has a regulation circuit charging a first storage capacitor to provide the first voltage output.

19. An electrical converter as defined in claim 17 wherein the output inductor charges a second storage capacitor providing the second voltage output.

20. An electrical converter comprising:

an alternating current (AC) plug body having a front surface with electrical contacts extending therefrom, the plug body having a peripheral dimension substantially contained within a maximum peripheral dimension of a mating AC duplex device two circuit boards mounted proximate a front edge to opposite ends of the vertical arm the plug body containing a power entry circuit mounted on one of said circuit boards with a line voltage input;

a startup regulator mounted on one of said circuit boards having a first rectifier connected to the power entry circuit and having a first voltage output;

a power supply mounted on one of said circuit boards and connected to the power entry circuit having a second rectifier and further having a power storage capacitor connected to the second rectifier, a first power FET connected to the power storage capacitor;

an output inductor connected to the power FET and charging a storage capacitor for a second voltage output, and a first switching regulator control circuit powered by the first voltage output for regulating switching of the first power FET, a converter and isolation circuit mounted on one of said circuit boards having a first isolation device connected between the second voltage output and a converter output;

means for controlling power through the first isolation device, and, a means for connecting an external power consuming device, said connecting means adapted for exit from the plug body perpendicular to the front surface.

21. An electrical converter as defined in claim 20 wherein the first isolation device is an isolation transformer and the means for controlling power through the first isolation device comprises:

a power FET controlling power across a primary winding of the transformer, a switching regulator control circuit powered by the first voltage output and regulating switching of the power FET, and a feedback circuit having a second isolation device for control of the switching regulator control circuit.

22. An electrical converter as defined in claim 20 wherein the startup regulator further comprises a regulation circuit connected to the first rectifier and charging an output capacitor providing the first output voltage, the startup regulator further having a feedback circuit for setting the first output voltage level.

23. An electrical converter as defined in claim 21 wherein the second isolation device is an optocoupler.

24. An electrical converter as defined in claim 23 wherein the optocoupler is controlled by a comparator receiving a bandgap voltage derived from the converter output.

25. An electrical converter comprising: an alternating current (AC) plug body having a front surface with electrical contacts extending therefrom, the electrical contacts extending rearwardly from said front surface and including an integral vertical arm supporting two circuit boards mounted proximate a front edge to opposite ends of the vertical arm the plug body receivable by an alternating current receptacle outlet having a peripheral dimension as specified in NEMA standard 5-15R for an individual duplex device with two receptacles each having a general dimension of a 1.343 inch diameter circle truncated on the top and bottom by horizontal chords spaced at 1.125 inches from the center, the AC plug body having a peripheral dimension substantially conforming to the mating AC receptacle, the plug body containing a power entry circuit mounted on one of said circuit boards with a line voltage input and having a power storage capacitor, a supply power FET connected to the power storage capacitor;

an output inductor connected to the power FET and charging a second storage capacitor connected to the converter output, and a supply switching regulator control circuit powered by the startup regulator for regulating switching of the first power FET, the power entry circuit further having a fuse for disconnecting the line voltage input and a parallel transient protection diode connected across the line voltage input;

a startup regulator mounted on one of said circuit boards having a first rectifier connected intermediate the power entry circuit and a regulation circuit charging an output capacitor providing a first output voltage, the startup regulator further having a feedback circuit for setting output voltage level;

a power supply mounted on one of said circuit boards having a second rectifier connected to the power storage capacitor of the power entry circuit and controlled by the first voltage output, the power supply having a second voltage output;

a converter and isolation circuit mounted on one of said circuit boards having an isolation transformer connected between the second voltage output and a converter output;

a second power FET controlling power across a primary winding of the transformer, a catch diode across the primary winding, a switching regulator control circuit powered by the first voltage output and regulating switching of the power FET, and a feedback circuit having an optocoupler controlled by a comparator receiving a bandgap voltage derived from the converter output for control of the switching regulator control circuit.

* * * * *